US005942481A

United States Patent [19]

Talley

[11] Patent Number: 5,942,481

[45] **Date of Patent: *Aug. 24, 1999**

[54] CAUSTIC CLEANING COMPOSITION HAVING LOW FREEZING POINT

[75] Inventor: Charles Bullick Talley, Highlands Ranch, Colo.

[73] Assignee: Charvid Limited Liability Co., Commerce City, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/874,086

[22] Filed: Jun. 12, 1997

[51] Int. Cl.[6] ..... C11D 7/06; C11D 7/08; C11D 7/10

[52] U.S. Cl. ..... 510/247; 510/179; 510/181; 510/220; 510/221; 510/223; 510/225; 510/229; 510/232; 510/233; 510/247; 510/252; 510/253; 510/272; 510/405; 510/435

[58] Field of Search ..... 510/179, 181, 510/220, 221, 223, 225, 229, 232, 233, 247, 252, 253, 272, 405, 435

[56] References Cited

U.S. PATENT DOCUMENTS

| | | | |
|---|---|---|---|
| 2,615,846 | 10/1952 | Dvorkovitz et al. | 252/156 |
| 2,976,248 | 3/1961 | Otrhalek | 252/156 |
| 3,607,764 | 9/1971 | Crotty et al. | 252/139 |
| 3,666,667 | 5/1972 | Wieczorek | 252/87 |
| 4,000,082 | 12/1976 | Otrhalek et al. | 252/135 |
| 4,017,410 | 4/1977 | Sorgenfrei et al. | 252/156 |
| 4,230,592 | 10/1980 | Miller et al. | 252/156 |
| 4,388,205 | 6/1983 | Stettler et al. | 252/135 |
| 4,751,023 | 6/1988 | Stehlin et al. | 252/558 |
| 4,762,638 | 8/1988 | Dollman et al. | 252/135 |
| 5,019,290 | 5/1991 | Bruegge et al. | 252/135 |
| 5,250,230 | 10/1993 | Steele et al. | 252/544 |
| 5,364,551 | 11/1994 | Lentsch et al. | 252/156 |
| 5,382,295 | 1/1995 | Aoki et al. | 134/2 |
| 5,591,702 | 1/1997 | Murphy | 510/202 |
| 5,704,947 | 1/1998 | Kaiser et al. | 8/111 |

*Primary Examiner*—Mark Kopec
*Assistant Examiner*—Charles Boyer
*Attorney, Agent, or Firm*—Sheridan Ross P.C.

[57] ABSTRACT

The caustic cleaner of the present invention has a freezing point of no more than about 40° F. The caustic cleaner is a mixture of aqueous sodium hydroxide and an organic salt derived from the reaction of sodium hydroxide and gluconic acid at elevated temperatures.

13 Claims, 1 Drawing Sheet

CAUSTIC CLEANING COMPOSITION HAVING LOW FREEZING POINT

FIELD OF THE INVENTION

The present invention relates generally to caustic cleaning compositions and specifically to a caustic cleaning composition having a relatively low freezing point.

BACKGROUND OF THE INVENTION

Caustic cleaning compositions are widely used in a variety of applications for removing a wide variety of organic and inorganic deposits. Sodium hydroxide, or caustic soda, is highly reactive with such deposits.

Caustic cleaning compositions have a freezing point that is too high for many applications. A typical caustic cleaning composition has a sodium hydroxide concentration ranging from about 25 to about 49% by weight. At such concentrations, the caustic cleaning composition can have a freezing point ranging from about 50° F. to about 88° F. Although it is known to add salts to the caustic cleaning composition, the depression in the freezing point of the composition from such additives is commonly relatively small (i.e., less than about 10° F.)

There is a need for a caustic cleaning composition having a relatively low freezing point.

SUMMARY OF THE INVENTION

These and other needs are addressed by the caustic cleaning composition of the present invention and the method for its manufacture. The caustic cleaning composition comprises (a) at least about 35% by weight sodium hydroxide and (b) an organic salt derived from the reaction of gluconic acid with sodium hydroxide. Most preferably, the composition comprises from about 2 to about 5% by weight of the organic salt.

The organic salt is believed to behave like a surfactant in the composition and significantly lower the freezing point of the composition. For a caustic cleaning solution having from about 35 to about 50% by weight sodium hydroxide, the freezing point of the composition is preferably no more than about 40° F. and most preferably ranges from about 24 to about 36° F.

While not wishing to be bound by any theory, it is believed that the salt can be a cyclic ring compound, such as a lactone and/or a straight chain compound having one or more attached hydrocarbyls containing 12 to 36 carbon atoms. The salt is believed to form in response to the latent heat of reaction between sodium hydroxide and water (which is added to the sodium hydroxide before and/or after the contacting step) and/or between sodium hydroxide and gluconic acid. The derivation of the salt in the aqueous sodium hydroxide solution from the reaction of gluconic acid and sodium hydroxide is believed to enhance the solubility of the salt in the solution compared to the addition of the salt directly to the solution.

The caustic cleaning composition can include other additives to further enhance the composition's properties. By way of example, the composition can include a hydroxy acid salt, namely a gluconate with a heptagluconate being most preferred. The gluconate acts as an inhibitor for oxalate formation during cleaning of kettles and other equipment used in the brewing of beer. The composition preferably includes from about 0.1 to about 3%. by weight of the gluconate. The composition can include an inorganic salt, preferably derived potassium hydroxide, to provide a further reduction in the freezing point of the composition. The inorganic salt is preferably added in an amount near its solubility limit in the composition. Preferably, the inorganic salt has a concentration ranging from about 1 to about 8% by weight of the composition.

The process for producing the caustic cleaning composition is an important aspect of the present invention. The process includes contacting the gluconic acid with the aqueous sodium hydroxide solution to form an organic caustic solution. It is important that the gluconic acid be added to a vessel containing the sodium hydroxide. Surprisingly, the same freezing point depression is not realized when the sodium hydroxide is added to a vessel containing the gluconic acid. During the contacting step, the sodium hydroxide solution preferably has a temperature ranging from about 72 to about 122° F. The preferred molar ratio of the gluconic acid to the sodium hydroxide ranges from about 1 to about 100. The molar ratio typically produces a concentration of the organic salt in the caustic solution ranging from about 1.5 to about 9% by weight. The strongly exothermic reaction between the gluconic acid and the sodium hydroxide is believed to produce an uneven temperature distribution in the solution with the highest temperature(s) being at the point(s) of addition of the gluconic acid.

After the contacting step, first the inorganic salt and second the gluconate are added to the solution.

DETAILED DESCRIPTION

Figure 1:
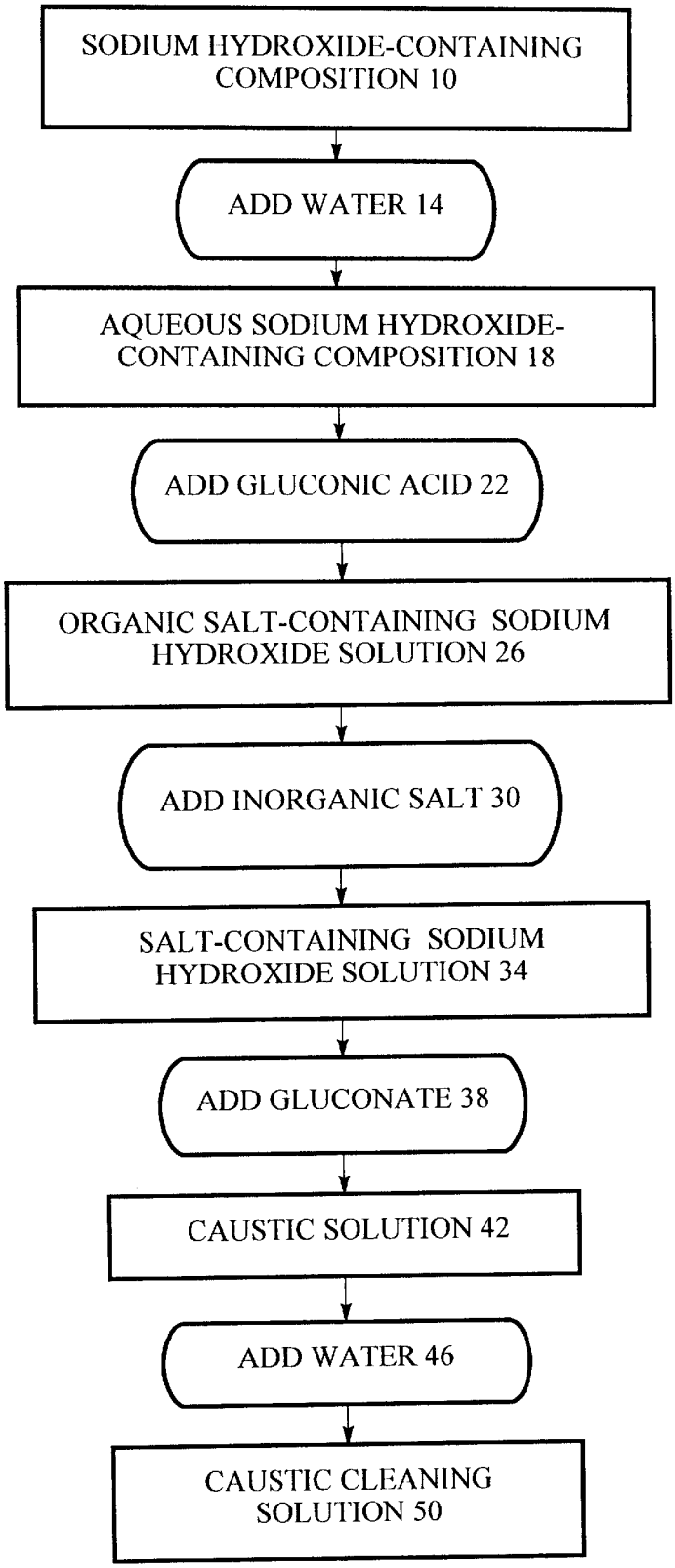
FIG. 1 is a flow schematic of the process of the present invention.

The caustic cleaning composition of the present invention has surprising and unexpected properties. The composition has a freezing point significantly less than that of conventional caustic cleaners. Preferably, the freezing point of the cleaner of the present invention is no more than about 40° F. and more preferably ranges from about 24 to about 36° F. and most preferably from about 28 to about 32° F.

The caustic cleaning composition realizes the low freezing point primarily through the use of an organic salt derived from the reaction of sodium hydroxide and gluconic acid. The organic salt may include one or more lactones and/or a gluconate having hydrocarbyl groups containing 6 to 72 carbon atoms.

An inorganic salt provides an additional reduction in the freezing point because of dissociated ions in the caustic cleaning composition. Preferred inorganic salts include derivatives hydroxides, silicates and mixtures thereof, more preferred inorganic salts are potassium hydroxide derivatives, sodium silicates, potassium silicates, and mixtures thereof with potassium hydroxide and mixtures thereof being most preferred.

The concentrations of the organic and inorganic salts are important to the performance of the caustic cleaning solution. The concentration of the organic salt preferably is at least about 1% by weight and more preferably ranges from about 2.5 to about 9 and most preferably from about 3 to about 5% by weight. The concentration of the inorganic salt preferably is at least about 2% by weight and more preferably ranges from about 3 to about 6 and most preferably from about 3.5 to about 4.5% by weight.

For applications where oxalates can form (e.g., applying the cleaning solution to beer kettles), the caustic cleaning solution can include a gluconate, with sodium heptagluconate being most preferred. The concentration of the gluconate preferably is at least about 0.5% by weight and more preferably ranges from about 0.5 to about 5 and most preferably from about 2.5 to about 3.5% by weight.

Referring to FIG. 1, a method for producing the caustic cleaning composition of the present invention is depicted. The sodium hydroxide-containing composition 10 can be anhydrous or aqueous sodium hydroxide, with substantially anhydrous sodium hydroxide being most preferred. Preferably, the sodium hydroxide-containing composition comprises at least about 30, more preferably from about 42 to about 55 and most preferably from about 38 to about 41% by weight sodium hydroxide.

Water is added 14 to the sodium hydroxide-containing composition 10 to form an aqueous sodium hydroxide-containing composition 18. The amount of water added to the composition 10 is preferably sufficient to provide a temperature of the aqueous sodium hydroxide-containing composition 18 of at least about 65° F. and more preferably ranging from about 70 to about 80° F. and most preferably from about 72 to about 76° F. The preferred molar ratio of water to the sodium hydroxide in the composition 10 ranges from about 1:1.5 to about 1:2.5, more preferably from about 1:1.7 to about 1:2.3, and most preferably from about 1:1.9 to about 1:2.1.

The aqueous sodium hydroxide-containing composition 18 has an amount of water preferably ranging from about 40 to about 60, more preferably from about 45 to about 55, and most preferably from about 48 to about 52% by weight.

Next, gluconic acid is added 22 to the composition 18 to form an organic salt-containing sodium hydroxide solution 26. The preferred molar ratio of gluconic acid to the sodium hydroxide in the composition 18 ranges from about 1:140 to about 1:120, more preferably from about 1:110 to about 1:100, and most preferably from about 1:105 to about 1:95. Commonly, these molar ratio ranges equate to a concentration of the organic salt (derived from the gluconic acid) in the solution 26 ranging from about 2 to about 4, more preferably from about 2.5 to about 3.75, and most preferably from about 2.75 to about 3.5% by weight.

The temperature of the solution 26 increases due to the exothermic reaction between the gluconic acid and the sodium hydroxide. The temperature of the solution varies depending upon the point of temperature measurement in the solution. The highest temperature, of course, is at the point(s) of addition of the gluconic acid. The temperature of the solution preferably ranges from about 100 to about 150, more preferably from about 110 to about 140, and most preferably from about 120 to about 130° F.

While not wishing to be bound by any theory, it is believed that the concentration of the organic salt in the solution 26 is not substantially uniform throughout the volume of the solution 26. It is believed that the salt concentration varies depending upon the point of measurement. The uneven distribution of the organic salt is believed to yield better rinsing and sheeting action than conventional caustic cleaners.

Before adding the next component, namely the inorganic salt, the solution 26 is agitated to provide thorough mixing. Preferably, the solution 26 is agitated for a time period ranging from about 0.5 to about 70, more preferably from about 20 to about 60, and most preferably from about 30 to about 45 minutes after addition of the gluconic acid.

After the salt is thoroughly mixed in the solution 26, the inorganic salt is added 30 to the solution 26 to form a salt-containing sodium hydroxide solution 34. The salt concentration in the solution 34 is preferably at or near the solubility limit of the salt in the solution. The most preferred inorganic salt is a derivative potassium hydroxide. Preferably, the concentration of the inorganic salt in the salt-containing sodium hydroxide solution ranges from about 2 to about 6% by weight.

Next, gluconate (other than the organic salt derived from the reaction of sodium hydroxide and gluconic acid) is added 38 to the solution 34 to form a caustic solution 42 to inhibit oxalate formation. The most preferred gluconate is sodium heptagluconate. Preferably, the concentration of the gluconate in the caustic solution ranges from about 0.1 to about 0.3% by weight.

Finally, water is added 46 to the caustic solution 42 to form the caustic cleaning solution 50. Preferably, the amount of water added to the solution 42 is sufficient to provide a temperature of the caustic cleaning solution 50 of at least about 120° F. and more preferably ranging from about 122 to about 130° F. and most preferably from about 125 to about 128° F. The preferred molar ratio of water to the sodium hydroxide in the solution 42 ranges from about 2.7:1.2 to about 3.3:1, more preferably from about 2.8:1.2 to about 3.1:1.1, and most preferably from about 2.9:1.2 to about 3.1:1.1. The concentration of water in the caustic cleaning solution 50 preferably ranges from about 49 to about 59, more preferably from about 51 to about 57, and most preferably from about 52 to about 56% by weight.

The caustic cleaning solution 50 is thereafter agitated for a period ranging from about 15 to about 30 minutes to permit the reaction between the sodium hydroxide and gluconic acid to be completed.

EXPERIMENTAL

A series of experiments were performed to quantify the effects of various additives on the freezing point of an aqueous sodium hydroxide solution. In the experiments different additives, namely gluconic acid, oligomeric gluconic acid, EDTA-100 (ethylenediamine tetracetic acid), sodium gluconate, TRITON BG-10, potassium hydroxide, and sodium heptagluconate, were combined with the aqueous sodium hydroxide solution and the freezing point determined.

Experiment 1

A 50% by weight aqueous caustic soda solution was combined with water in the following amounts:

Caustic Soda—50% solution 78.0% by weight

Water 22.0% by weight

Before the addition of the water, the temperature of the 50% caustic soda solution was 72° F. After the addition of the water, the temperature of the aqueous caustic soda solution was 118° F. The freezing point of the aqueous solution was measured and found to be 53° F. This temperature matches the published freezing point of an aqueous caustic soda solution having the same composition as the test solution.

Experiment 2

A 50% by weight aqueous caustic soda solution was combined first with a 50% by weight aqueous gluconic acid solution and second with water in the following amounts:

Caustic Soda 50% Solution 78% by weight

Gluconic Acid 50% Solution 3% by weight

Water 19% by weight

Before the addition of the gluconic acid and water, the 50% caustic soda solution had a temperature of 72° F. After the addition of the gluconic acid solution, the solution had a temperature of 84° F. After the further addition of water, the solution had a temperature of 122° F. The freezing point of the final solution (i.e., containing caustic soda, gluconic acid or derivatives thereof, and water) was measured and found to be 36° F.

Experiment 3

A 50% by weight aqueous caustic soda solution was combined first with EDTA-100 and second with water in the following amounts:

Caustic Soda—50% Solution 78% by weight

EDTA-100 (Ethylenediamine Tetracetic Acid)—36% 3% by weight

Water 19% by weight

Before the addition of the EDTA-100 and water, the starting temperature of the 50% caustic soda solution was 72° F. After the addition of the EDTA-100, the temperature of the solution was 78° F. After the further addition of water, the temperature of the solution was 116° F. The freezing point of the combined solution (i.e., containing caustic soda, EDTA-100, and water) was measured and found to be 48° F. The freezing point is only slightly less than the freezing point of the aqueous caustic soda solution of Experiment 1.

A possible reason for the relatively small decrease in the freezing point is the low solubility of EDTA-100 in the 50% caustic soda solution. After the addition of the EDTA-100, the solution turned completely white and, after one hour of settling, a small amount of EDTA-100 was observed on the bottom of the container and floating on the top of the solution.

Experiment 4

A 50% by weight aqueous caustic soda solution was combined with sodium gluconate ($NaC_6H_{11}O_7$) and water in the following amounts:

Caustic Soda 50% Solution 78% by weight

Sodium Gluconate 3% by weight

Water 19% by weight

Before the addition of sodium gluconate and water, the starting temperature of the aqueous caustic soda solution was 72° F. After the addition of sodium gluconate and water, the temperature of the solution was 116° F. The freezing point of the combined solution (i.e., containing caustic soda, sodium gluconate, and water) was measured and found to be 42° F. The freezing point is slightly less than the freezing point of the aqueous caustic soda solution of Experiment 1. The decrease in freezing point was less than that experienced with gluconic acid in Experiment 2.

Experiment #4 was abandoned due to the very poor mixing of the powdered sodium gluconate into the sodium hydroxide. The product of the mixing was a balling of gluconate. This end result is a normal reaction. The addition of the water and sodium gluconate mixture directly to the 50% caustic soda solution mirrors standard industrial practice and is the only order of addition done in this series of experiments.

Based on the results of this experiment, it appears that the organic salt is not simply sodium gluconate because the dramatic decrease in the freezing point of the caustic cleaning solution of the present invention is not realized simply by adding sodium gluconate to the aqueous caustic soda solution. Rather, the decrease in freezing point appears to be realized only when gluconic acid is added directly to the aqueous sodium hydroxide solution.

Experiment 5

A 50% by weight aqueous caustic soda solution was combined first with TRITON BG-10 and second with water in the following amounts:

Caustic Soda—50% 78% by weight

Triton BG-10 (Sugar surfactant) 3% by weight

Water 19% by weight

Before the addition of TRITON BG-10 and water, the starting temperature of the aqueous caustic soda solution was 72° F. After the addition of TRITON BG-10, the temperature of the solution was 72° F. After the further addition of water, the temperature of the solution was 118° F. The freezing point of the combined solution (i.e., containing caustic soda, TRITON BG-10, and water) was measured and found to be 48° F. The freezing point is slightly less than the freezing point of the aqueous caustic soda solution of Experiment 1. The decrease in freezing point was significantly less than that experienced with gluconic acid in Experiment 2 and sodium gluconate in Experiment 4.

After the addition of the TRITON BG-10 a jell formed. It was broken with the addition of water which took 10 minutes to completely dissolve.

Experiment 6

A 50% by weight aqueous caustic soda solution was combined first with potassium hydroxide (KOH) and second with water in the following amounts:

Caustic Soda—50% solution 78% by weight

Potassium Hydroxide (Solution) 3% by weight

Water 19% by weight

Before the addition of KOH and water, the starting temperature of the aqueous caustic soda solution was 72° F. After the addition of KOH, the temperature of the solution was 74° F. After the further addition of water, the temperature of the solution was 112° F. The freezing point of the combined solution (i.e., containing caustic soda, KOH, and water) was measured and found to be 36° F. The freezing point is equivalent to the freezing point measured in Experiment 2.

Experiment 7

A 50% by weight aqueous caustic soda solution was combined first with sodium heptagluconate and second with water in the following amounts:

Caustic Soda—50% (solution) 78% by weight

Sodium Heptagluconate (Solution) 3% by weight

Water 19% by weight

Before the addition of sodium heptagluconate and water, the starting temperature of the aqueous caustic soda solution was 72° F. After the addition of sodium heptagluconate, the temperature of the solution was 80° F. After the further addition of water, the temperature of the solution was 118° F. The freezing point of the combined solution (i.e., containing caustic soda, sodium heptagluconate, and water) was measured and found to be 48° F. The freezing point is slightly less than the freezing point of the aqueous caustic soda solution of Experiment 1. The decrease in freezing point was significantly less than that experienced with gluconic acid in Experiment 2, KOH in Experiment 6, and sodium gluconate in Experiment 4.

The level of the sodium heptagluconate was such that an excessive amount of ammonia was released.

Experiment 8

A 50% by weight aqueous caustic soda solution was combined first with gluconic acid, second with KOH, and third with water in the following amounts:

Caustic Soda—50% (solution) 78% by weight

Gluconic Acid—50% (solution) 3% by weight

Potassium Hydroxide—45% (solution) 3% by weight

Water 16% by weight

Before the addition of gluconic acid, KOH, and water, the starting temperature of the aqueous caustic soda solution was 72° F. After the addition of gluconic acid, the temperature of the solution was 86° F. After the further addition of KOH, the temperature of the solution was 87° F. After the further addition of water, the temperature of the solution was 118° F. The freezing point of the combined solution (i.e., containing caustic soda, sodium heptagluconate, and water) was measured and found to be 30° F. The freezing point is the lowest freezing point measured in any of the experiments.

Experiment 9

To compare the freezing point depression of gluconic acid with oligomeric gluconic acid, a 50% by weight aqueous caustic soda solution was combined first with oligomeric gluconic acid and second with water in the following amounts:

Caustic Soda—50% (solution) 78% by weight

Oligomeric Gluconic Acid 3% by weight

Water 19% by weight

To form the oligomeric gluconic acid, a 50% by weight gluconic acid solution was boiled for 10 minutes.

Before the addition of oligomeric gluconic acid and water, the starting temperature of the aqueous caustic soda solution was 72° F. After the addition of the oligomeric gluconic acid, the temperature of the solution was 86° F. After the further addition of water, the temperature of the solution was 122° F. The freezing point of the combined solution (i.e., containing oligomeric gluconic acid and water) was measured and found to be 36° F. The freezing point is equivalent to the freezing point measured in Experiment 2. Accordingly, gluconic acid and oligomeric gluconic acid appear to have the same impact on the freezing point of the solution.

All of the above experiments were performed in a 1000 ml beaker at 500 gram sample batches. The thermometer used was a standard laboratory model. The average mixing time was about 5 minutes.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method for forming a caustic cleaning composition having a low solidification temperature, comprising:

(a) contacting gluconic acid with an alkali metal hydroxide solution to form an intermediate caustic solution;

(b) thereafter contacting the intermediate caustic solution with sufficient water to produce a caustic solution containing from about 35 to about 55% by weight of the alkali metal hydroxide and having a temperature of at least about 120° F.; and (c) thereafter agitating the caustic solution to permit substantial completion of the reaction between the alkali metal hydroxide and gluconic acid, wherein the caustic solution has a solidification temperature that is no more than about 40° F.

2. The method of claim 1, further comprises:

adding, directly before the first contacting step, water to a solution comprising sodium hydroxide to form the hydroxide solution.

3. The method of claim 2, wherein the molar ratio of water to the sodium hydroxide ranges from about 1:1.5 to about 1:2.5.

4. The method of claim 2, wherein, after the first contacting step, the water content of the intermediate caustic solution ranges from about 40 to about 60% by weight.

5. The method of claim 1, wherein the molar ratio of gluconic acid to the alkali metal hydroxide ranges from about 1:140 to about 1:120.

6. The method of claim 1, wherein the alkali metal hydroxide solution is contained in a vessel and wherein the first contacting step comprises:

adding the gluconic acid to the alkali metal hydroxide solution in the vessel.

7. The method of claim 6, wherein, directly after the first contacting step, the intermediate caustic solution has an uneven temperature distribution.

8. The method of claim 1, wherein the caustic solution further comprises a metal-containing salt.

9. The method of claim 8, wherein the metal-containing salt constitutes from about 2 to about 6% by weight of the caustic solution.

10. The method of claim 1, wherein the caustic solution further comprises a heptagluconate.

11. The method of claim 10, wherein the heptagluconate constitutes from about 1 to about 5% by weight of the caustic solution.

12. The method of claim 1, wherein, directly before the first contacting step, the alkali metal hydroxide solution has a temperature ranging from about 65 to about 80° F.

13. The method of claim 12, wherein, directly after the first contacting step, the caustic solution has a temperature ranging from about 110 to about 140° F.

* * * * *